US008802951B2

(12) United States Patent
Hallerberg

(10) Patent No.: US 8,802,951 B2
(45) Date of Patent: Aug. 12, 2014

(54) GRAVITATING MUSICAL INSTRUMENT SUPPORT

(71) Applicant: Dale A Hallerberg, Lake Barrington, IL (US)

(72) Inventor: Dale A Hallerberg, Lake Barrington, IL (US)

( * ) Notice: Subject to any disclaimer, the term of this patent is extended or adjusted under 35 U.S.C. 154(b) by 0 days.

(21) Appl. No.: 13/870,074

(22) Filed: Apr. 25, 2013

(65) Prior Publication Data

US 2013/0283997 A1 Oct. 31, 2013

Related U.S. Application Data

(60) Provisional application No. 61/687,679, filed on Apr. 30, 2012.

(51) Int. Cl.
*G10D 13/02* (2006.01)

(52) U.S. Cl.
CPC ..... *G10D 13/026* (2013.01)
USPC ..... 84/421

(58) Field of Classification Search
USPC ..... 84/421
See application file for complete search history.

(56) References Cited

U.S. PATENT DOCUMENTS

| | | | | | |
|---|---|---|---|---|---|
| 219,921 | A * | 9/1879 | Davis | 300/19 |
| 342,062 | A | 5/1886 | Bemis | |
| 624,662 | A * | 5/1899 | Leedy | 248/187.1 |
| 1,049,072 | A * | 12/1912 | Frey | 16/317 |
| 1,059,192 | A * | 4/1913 | Mills | 84/421 |
| 1,299,810 | A | 4/1919 | Toole | |
| 2,290,410 | A | 6/1941 | Dawson | |
| 2,433,594 | A * | 12/1947 | Calo | 84/421 |
| 2,854,880 | A * | 10/1958 | Waters | 84/421 |
| 3,405,587 | A * | 10/1968 | Meazzi et al. | 84/421 |
| 3,405,588 | A * | 10/1968 | Della-Porta | 84/421 |
| 4,200,024 | A * | 4/1980 | Watson | 84/421 |
| 5,072,910 | A | 12/1991 | May | |
| 5,645,253 | A * | 7/1997 | Hoshino | 248/181.1 |
| 5,804,747 | A * | 9/1998 | Chen | 84/327 |
| 6,765,140 | B2 | 7/2004 | Crouch | |
| 6,963,023 | B2 * | 11/2005 | Hsieh | 84/421 |
| 7,576,276 | B2 * | 8/2009 | Hallerberg | 84/421 |
| 2013/0283997 | A1 * | 10/2013 | Hallerberg | 84/421 |

* cited by examiner

*Primary Examiner* — Robert W Horn
(74) *Attorney, Agent, or Firm* — Meroni & Meroni, P.C.; Charles F. Meroni, Jr.; Christopher J. Scott

(57) ABSTRACT

A support for musical instruments, especially marching percussion instruments such as multi-tenor sets, which uses a gravitating pivot to align the instrument in the proper orientation. The support simplifies and speeds the mounting of the instrument to a support stand. The support provides for interesting visual effects when desired by allowing the instrument to be easily spun around a vertical axis. The support is adaptable to different combinations of multi-tenor drum sets, such as doubles, triples, tri-toms, and quads.

20 Claims, 10 Drawing Sheets

GRAVITATING MUSICAL INSTRUMENT SUPPORT

PRIOR HISTORY

This non-provisional U.S. Patent Application claims the benefit of U.S. Provisional Patent Application No. 61/687,679 filed in the United States Patent and Trademark Office on 30 Apr. 2013, the specifications of which are hereby incorporated by reference thereto.

BACKGROUND OF THE INVENTION

1. Field of the Invention

This invention relates to new and useful improvements in support stands for drums and other musical instruments. More particularly, the present invention relates to a support stand for holding a set of multi-tenors often known as "triples" or "quads".

2. Brief Description of the Prior Art

Prior art for stands for musical instruments and especially for percussion instruments such as multi-tenors typically show the use of tripod stands with multiple rods for mating to various parts of the multi-tenor drums in order to hold the drums with the drumheads in a substantially horizontal orientation. The multiple rods are adjustable and normally include wing nuts or other tightening methods to hold the rods in place. Certain prior art drum stands are briefly described hereinafter.

U.S. Pat. No. 342,062, issued to Bemis, for example, discloses a Snare Drum. The Bemis patent describes a snare drum with three (or more) leg assemblies for supporting the drum at a height comfortable for practice or performance. The leg assemblies comprise hollow leg portions and lower leg portions telescopically receivable in the hollow leg portions. Screws function to selectively clamp the lower leg portions within the hollow leg portions so that the user can raise or lower the drum to suit the circumstance, or to cant or angle the drum as desired.

U.S. Pat. No. 624,662 ('662 patent), which issued to Leedy, for example, discloses a Drum Stand. The '662 patent describes a drum stand comprising a head piece having three projections radiating from the center of the top plane thereof, a pair of arms pivoted upon the head piece and extending radially over two of said projections, an arm rigidly secured to the head piece and extending over the other one of said projections, a turned-up lug at the free end of each of said arms, a rib to support each of said pivoted arms laterally at the side opposite said rigid arm, a clamping device at the underside of said head piece, and a supporting stand connected to said clamping device. The Leedy stand appears to be suitable for supporting a single drum.

U.S. Pat. No. 2,433,594 ('594 patent), which issued to Calo, generally discloses a folding tripod drum stand with a lateral support under the drum which is center supported. More particularly, the '594 patent describes a drum stand comprising a flat base of extended dimensions, an adjustable telescoping standard rising centrally from the base, a drum-supporting frame, and a ball and socket connection between the standard and the drum-supporting frame to thereby provide a support for the drum frame and in which the support elements are axially aligned and extend normal to the base plane.

The ball and socket members of such connection are carried respectively by the standard and the drum-supporting frame with the ball carried by the drum frame and having its center included within such axial alignment. The ball member has an equatorial roughened zone with the drum frame extending from a polar zone of the ball. The socket member has an open top to permit lateral swing of the drum frame with a limited range, said connection including an adjusting nut cooperative with the socket member to secure the ball member in adjusted position relative to the socket and to release the ball from the socket, the relation of ball and socket being such that co-operation between the equatorial zone of the ball and the socket will be present in all of the adjusted positions of the drum frame.

The drum frame includes an arm secured to and extending from a polar axis of the ball in a direction normal to the equatorial zone. The arm carries a laterally extending element the opposite free ends of which extend angularly to the direction of length of the element and in substantial parallelism to the direction of length of the said arm, said ends each carrying means for removably securing the drum.

U.S. Pat. No. 5,072,910 ('910 patent), which issued to May, discloses an Adjustable Tripod Stand. The '910 patent describes a tripod stand having independently adjustable legs comprising a longitudinal extensible upright portion of telescoping tubular members, a plurality of collar members slidably mounted on the upright portion which are longitudinally adjustable relative to one another and to the upright portion for selective positioning thereon, and a plurality of movable leg members operatively connected to upper and lower collar members for selective independent longitudinal positioning and radial extension relative to the upright portion and to one another.

When an upper leg supporting collar and the corresponding lower collar are moved toward each other on the upright portion, the bottom of the leg connected thereto will be extended radially outward independently of the other legs, and when the upper leg supporting collar and the corresponding lower collar are moved away from each other, the bottom of the leg connected thereto will be drawn radially inward independently of the other legs.

The independent positioning of the legs may be at different distances from the upright portion or in different planes relative to the other legs and thus allows the stand to be erected in limited or confined areas or on multi-level surfaces. The independent positioning of the legs also allows the longitudinal axis of the stand to be tilted to an off-vertical axis position for positioning the center of gravity of the supported vehicle within the supporting legs.

U.S. Pat. No. 5,645,253 ('253 patent) which issued to Hoshino, discloses a Universal Support for Drums. The '253 patent describes a universal support structure wherein the angular adjustment provided by the universal support for an object supported thereby remains fixed even though the object, such as a drum, has been removed from the universal support. The universal support is capable of holding a support rod relative to a support stand having an attachment member. The universal support includes a receiving member, with a rod press and a support stand press each attached to the receiving member.

The receiving member and the rod press each has a concave surface adapted to accommodate the rod support sandwiched between the contoured surfaces of the receiving member and the rod press. In addition, the receiving member and the support stand press each has a concave surface adapted to accommodate the attachment member of the support stand sandwiched between the concave surface of the receiving member and the support stand press. Thus, the universal support is capable of accommodating the attachment member of the support stand independently of the rod support.

None of the foregoing prior art related to drum or instrument stand assemblies shows a gravitating pivot assembly co-operable in conjunction with the stand assemblies. Some of the more pertinent prior art relating to gravitating pivot assemblies and the like are briefly described hereinafter. U.S. Pat. No. 219,921 ('921 patent), issued to Davis, for example, discloses a Table for Holding Broom-Straw.

The '921 patent describes a gravitating pivot assembly to orient the rotating assembly in a preferred position. More particularly, the Davis patent describes a post ratchet and a hub ratchet engage at a ratchet interface and effect a post-to-hub ratcheted interface for enabling a user to rotate a wheel and yet orient the wheel in the preferred position.

U.S. Pat. No. 1,049,072 ('072 patent), issued to Frey, discloses a Gravity Hinge. The '072 patent describes a gravity hinge comprising a dual-sectioned pivot pin having an upper pivot section and a lower pivot section. The lower end of the upper pivot section and the upper end of the lower pivot section comprise co-operable V-shaped or V-notched cam surfacing for orienting the hinge and attached door in a closed position.

U.S. Pat. No. 1,299,810 ('810 patent), issued to Toole et al., discloses a Theater Chair. The theater chair described by the '810 patent comprises a chair with a gravitating pivot construction formed under the center of the seat which construction, in part, uses gravity to orient the chair in a preferred position. U.S. Pat. No. 2,290,410 ('410 patent), discloses a Work Table Seat. The '410 patent describes a worktable seat with a pivot construction under the center of the seat which construction also uses gravity and a multitude of interlocking teeth to make free rotation of the seat difficult, but enables to user to selectively orient the seat relative to the work table portion of the construction.

While the above patents and many subsequent patents of the prior art disclose gravitating pivot assemblies or drum stands, none discloses that the instrument stand utilizes a single vertical post mounted to the set of drums to allow for fast and simple placement of the instrument on the stand. Further, none of the prior art discloses a gravitating pivot which aligns the drums in an orientation suitable for practice or performance, and none discloses a stand which allows for spinning the drums for an interesting visual effect. The prior art thus perceives a need for such a musical instrument stand construction as summarized in more detail hereinafter.

SUMMARY OF THE INVENTION

Various prior inventions have been disclosed that provide gravitating pivot assemblies or support stands for musical instruments such as percussion instruments and multi-tenor drums, but none of the listed inventions provide the structural features and functions stemming therefrom as provided by the present invention. An ideal musical instrument support construction would provide instrument support that is extremely stable under the use and abuse expected during heavy practice and performance.

Further, an ideal musical instrument support construction would be of a design that allows very quick mounting of the instrument, and very quick dismounting of the instrument. It would use few parts to simplify the use, reduce lost parts, and cut down on manufacturing costs. It would require no further adjustment or tightening once installed. It would firmly attach to the instrument in an unobtrusive location. It would be robust, yet as low in weight as possible. The proposed invention provides these features.

One of the objects of this invention is to provide instrument support that is extremely stable. This is attained by attaching the vertical post of this invention permanently to a set of drums, placed at or near the center-of-gravity of the instrument, and mating the post with a snug-fitting vertically-oriented sleeve that is at the top of an instrument stand.

Another object of this invention is to allow very quick mounting and dismounting of the instrument to the stand. This is attained by the single vertical cylindrical post of the invention which is easy to place into the vertically-oriented sleeve that is at the top of an instrument stand and is also easy to remove from the stand.

Another object of this invention is to align the instrument in a preferred orientation for practice or performances. This is attained by the unique shape of the annular ring on the vertical post which mates with the vertically-oriented receiver that is at the top of an instrument stand in order to use gravity to orient the drums in the preferred orientation. With the single vertical post mounted at or near the center of gravity of the set of drums, the drums rotate due to the gravitating effect and settle into the preferred orientation.

Another object of this invention is to allow rotation of the drums for interesting visual effects. This is attained by the rotation of the single vertical post in the vertically-oriented sleeve. At the conclusion of the effect, the performer can stop the rotation and the drums will gravitate to the preferred orientation.

It will thus be seen that the gravitating musical instrument support according to the present invention provides a method to hold the drums stably in a horizontal position for practice or performance, and provides for fast placement of the drums on the stand. It will be further understood that the gravitating musical instrument support according to the present invention also allows for spinning the drums around a center axis for interesting visual effects. Other various objects, features, aspects, and advantages of the present invention, in addition to the foregoing, will become more apparent from the following brief description of drawings, detailed description of preferred embodiments of the invention, along with the accompanying drawings in which like numerals represent like components.

PARTS LIST

20—Gravitating Instrument Support Assembly
- 21—Post
- 23—Gravitating Annular Ring
- 25—Mounting Plate
- 26—Flange
- 27—Post Tip
- 28—Mounting Hole
- 30—Flat Ring Section
- 41—Angled Lower Edge

13—Receiver Construction
- 18—Sleeve Opening
- 19—Gravitating Sleeve End
- 22—Sleeve
- 24—Riser
- 29—Flat Upper Surface
- 42—Angled Upper Edge

31—Threaded Fastener Member

10—Stand Base Assembly
- 15—Legs
- 16≠Upright Member
- 17—Screw Member

14—Drum Set Assembly
- 11—Abbreviated Support Frame
- 12—Prior Art Support Frame
- 32—Casing Unit
- 33—Drum
- 34—Upper Plate
- 35—Lower Plate
- 36—Tension Rod
- 37—Drum Rim
- 38—Curved Recess
- 39—Peripheral Ridges
- 40—Bores

100—Main Vertical Axis
- 101—Axial Rotation
- 102—Post Axis
- 103—Sleeve Axis
- 110—0 Rotational Degree Point
- 111—90 Rotational Degree Point
- 112—180 Rotational Degree Point
- 113—270 Rotational Degree Point

DETAILED DESCRIPTION OF THE PREFERRED EMBODIMENT

Figure 1:
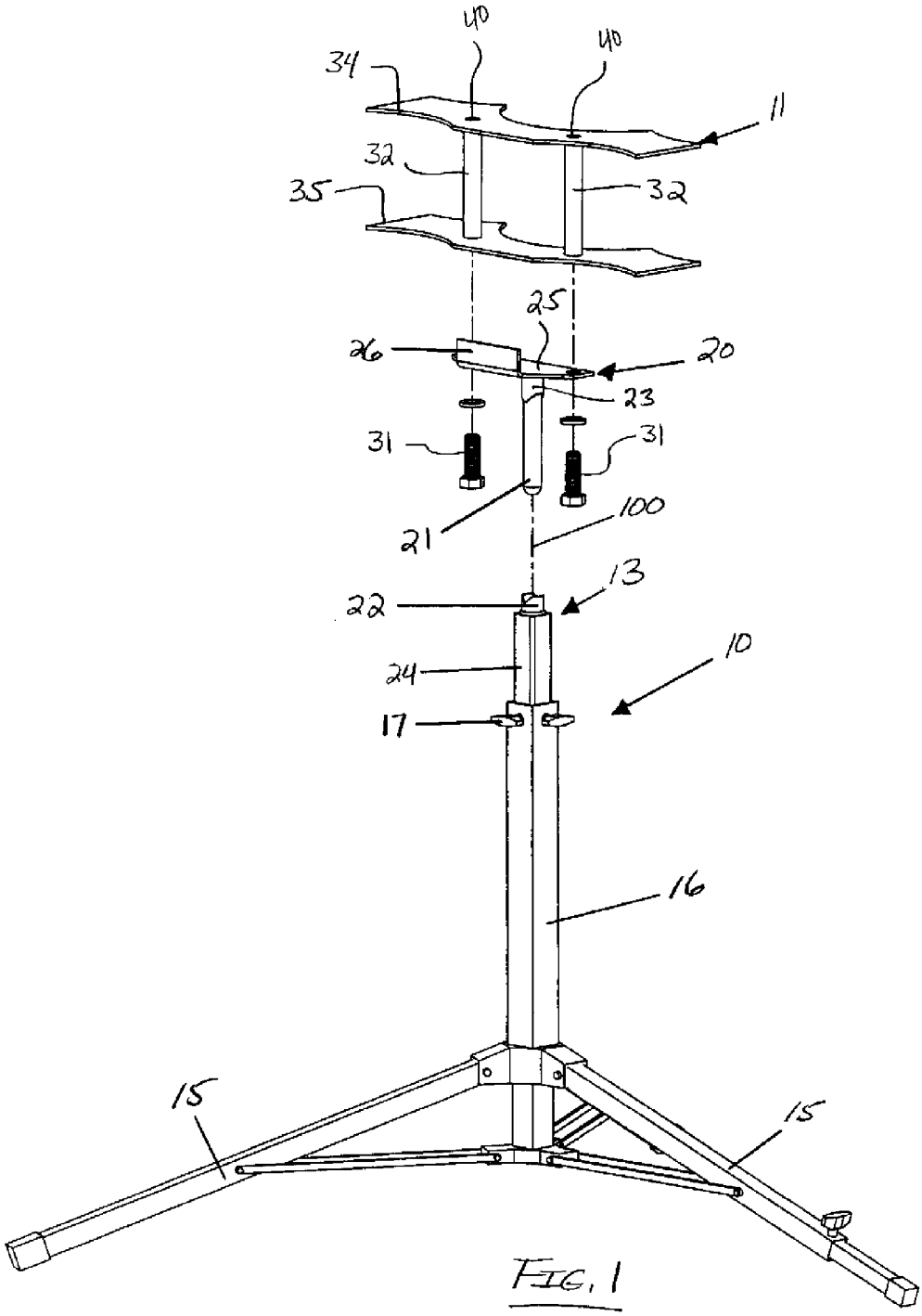
FIG. 1 is an exploded top perspective view of, from bottom to top, a generic drum stand assembly, a gravitating musical instrument support assembly according to the present invention, and a generic drum support frame with certain fastening hardware included in the exploded view for attaching the support frame to the gravitating musical instrument support assembly.
Figure 2:
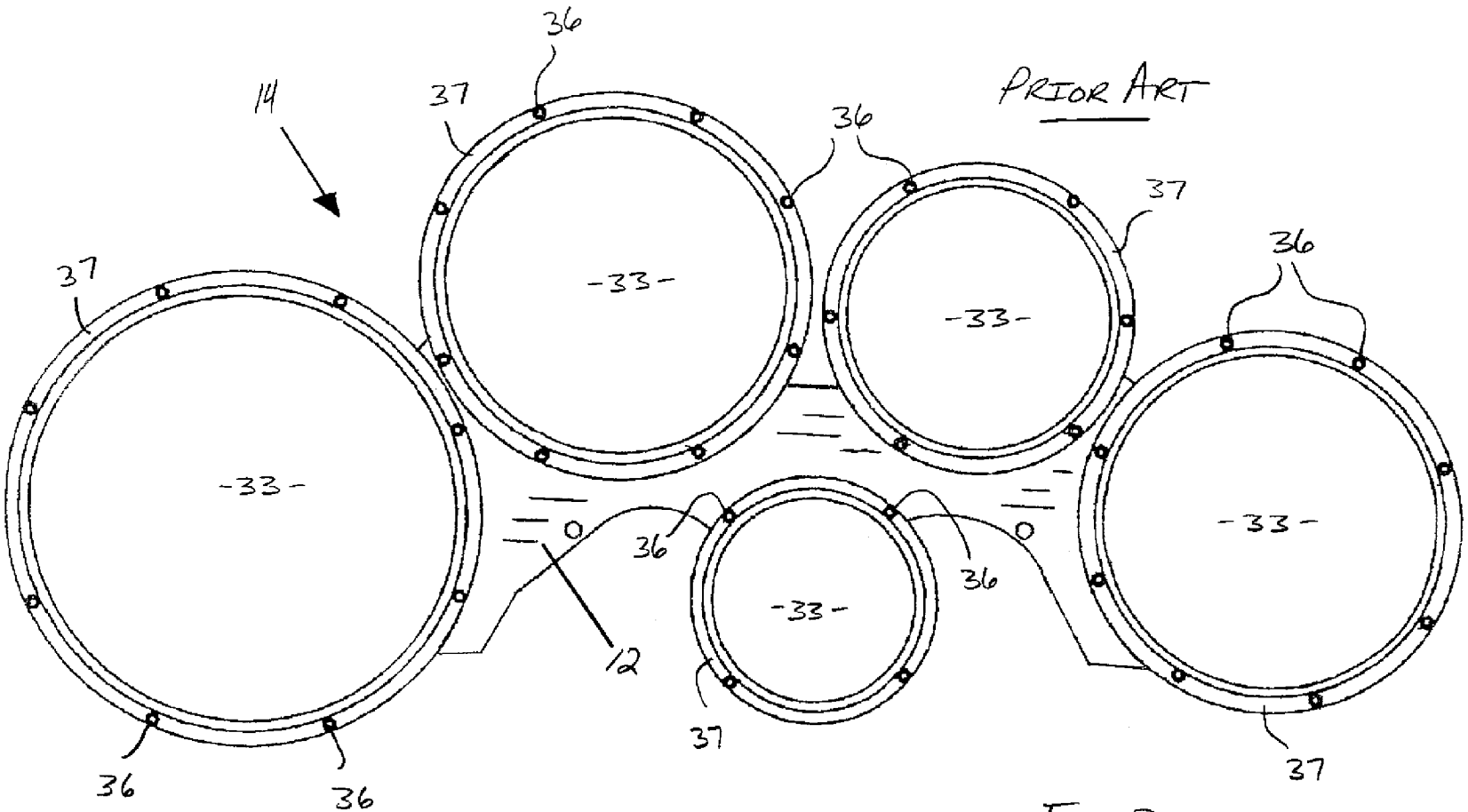
FIG. 2 is a top plan view of a prior art drum set assembly including a centralized drum support frame and an arrangement of drums peripherally attached to said support frame.
Figure 3:
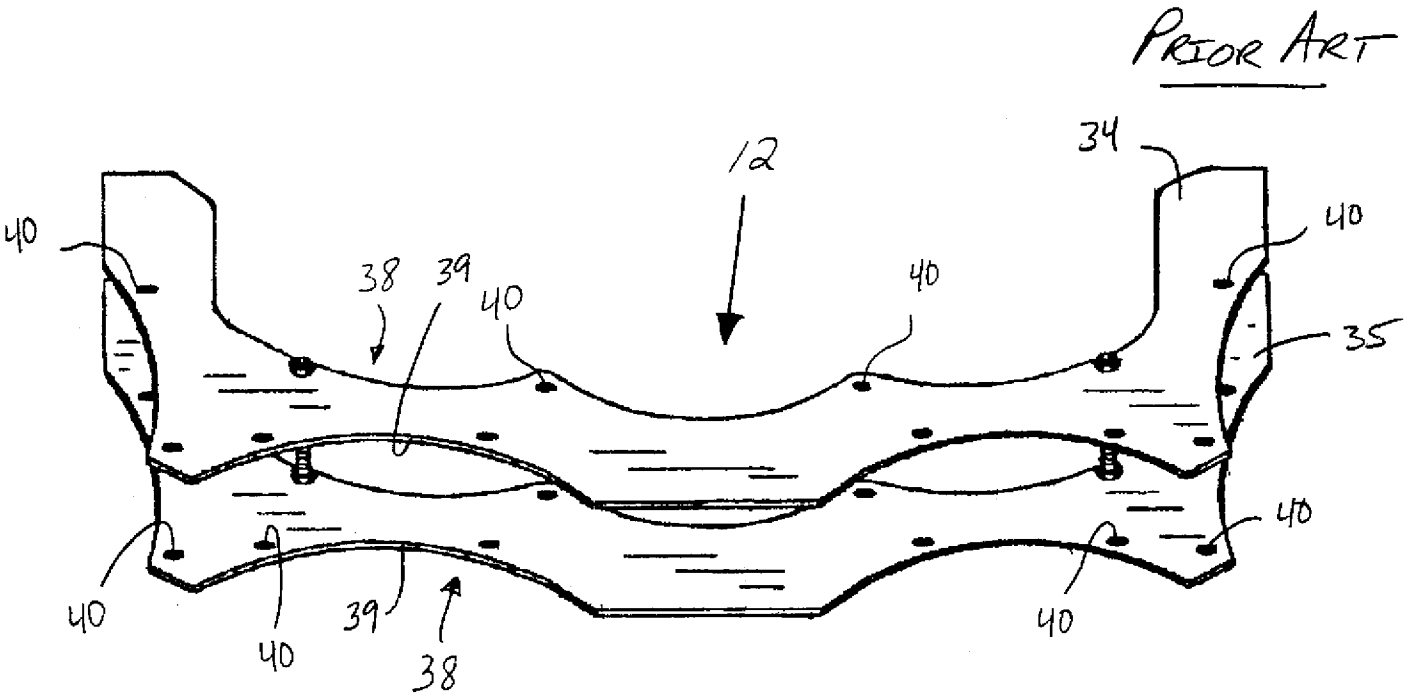
FIG. 3 is a top perspective view of the prior art drum support frame otherwise depicted in FIG. 3 with the drums removed therefrom.
Figure 4:
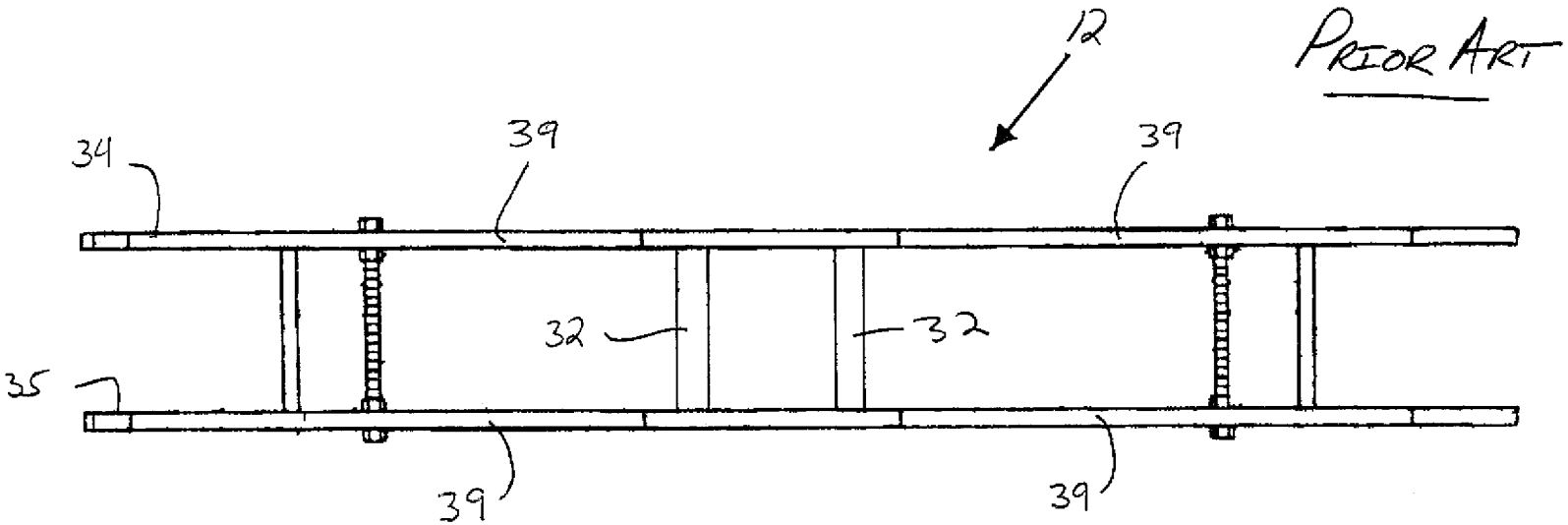
FIG. 4 is a elevational edge view of the prior art drum support frame otherwise depicted in FIG. 2 with two drum casing units disposed centrally relative to the support frame to which drum casing units the gravitating musical instrument support assembly according to the present invention fastens.

Referring now the drawings with more specificity, FIG. 1 generally depicts a gravitating musical instrument support assembly 20 according to the present invention in exploded relation relative to a tripod type support stand assembly as at 10, and an abbreviated percussion instrument support frame as at 11. From a comparative inspection of FIGS. 1-4, it will be seen that the abbreviated percussion instrument support frame 11 is relatively abbreviated in overall length as compared to the prior art percussion instrument support frame(s) 12 otherwise depicted in FIGS. 2-4.

The abbreviated percussion instrument support frame 11 is shown abbreviated in length to highlight certain centralized structures that attach to the gravitating instrument support assembly 20 according to the present invention. In practice, the gravitating musical instrument support 20 according to the present invention attaches to a support frame of the type generally depicted and referenced at 12.

The complete assembly thus preferably comprises a tripod type support stand assembly as at 10, a receiver construction as at 13; the gravitating musical instrument support assembly 20; and a set of drums as generally depicted at 14, which set of drums or drum set assembly 14 preferably comprises a percussion instrument support frame of the type referenced at 11 or 12. The present invention essentially comprises the receiver construction 13 and the support assembly 20, which components are cooperable with prior art stand assemblies of the type generally depicted and referenced at 10 and prior art drum set assemblies of the type generally depicted and referenced at 14.

The tripod type support stand assembly 10 is shown as a typical tripod with folding legs 15 and adjustable height. Notably, the support stand assembly 10 further comprises an upwardly oriented member 16 matable with a receiver construction 13 cooperable with the gravitating musical instrument support assembly 20 according to the present invention. This stand base arrangement has been illustrated to depict a preferred embodiment or ensemble operable in conjunction with the present invention.

The receiver construction 13 is telescopically received in the upright member 16 and is height adjustable, preferably by way of screw type fasteners 17 as generally depicted and referenced in FIG. 1. The gravitating musical instrument support assembly 20 is secured to the drum set assembly 14. The drum set assembly 14 is installed on the support stand assembly 10 by placing the post tip 27 of the support assembly 20 at the sleeve opening 18 of the receiver construction 13 and axially aligning the post 21 with the receiver construction 13 so that it will slide into the receiver construction 13 and fully engage the gravitating annular ring 23 of the support assembly 20 with the gravitating sleeve end 19 of the receiver construction 13. The prior art drum set assembly 14 is shown as a typical multi-tenor set, and this prior art arrangement is cooperable with the present invention.

As earlier stated, the present invention basically and preferably comprises two parts or elements, namely, the support assembly 20 and the receiver construction 13. The support assembly 20 is mated to the receiver construction 13, and when so mated, the post 21 of the assembly 20 is not visible, being inserted into the sleeve 22 of the receiver construction 13. The gravitating annular ring 23 nests into the V-shaped top end of the gravitating sleeve end 19. The Sleeve 22 is supported by the riser 24 of the receiver construction 13. The post 21 and gravitating annular ring 23 are fastened to the mounting plate 25. The mounting plate 25 may be stabilized by the optional flange 26.

Figure 5:
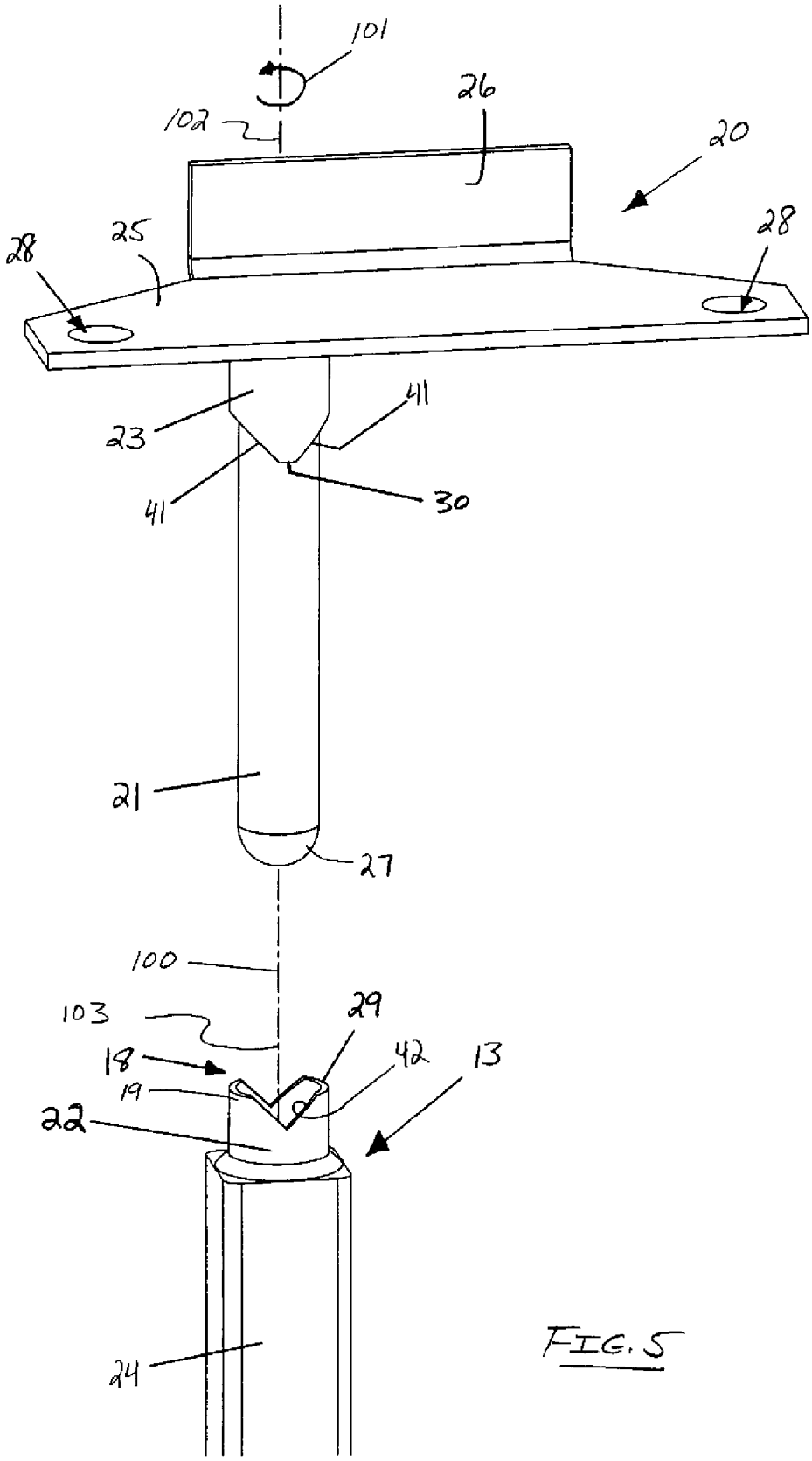
FIG. 5 is an enlarged fragmentary top perspective exploded view of the gravitating musical instrument support assembly juxtaposed in superior adjacency to a fragmentary receiver construction according to the present invention.
Figure 6:
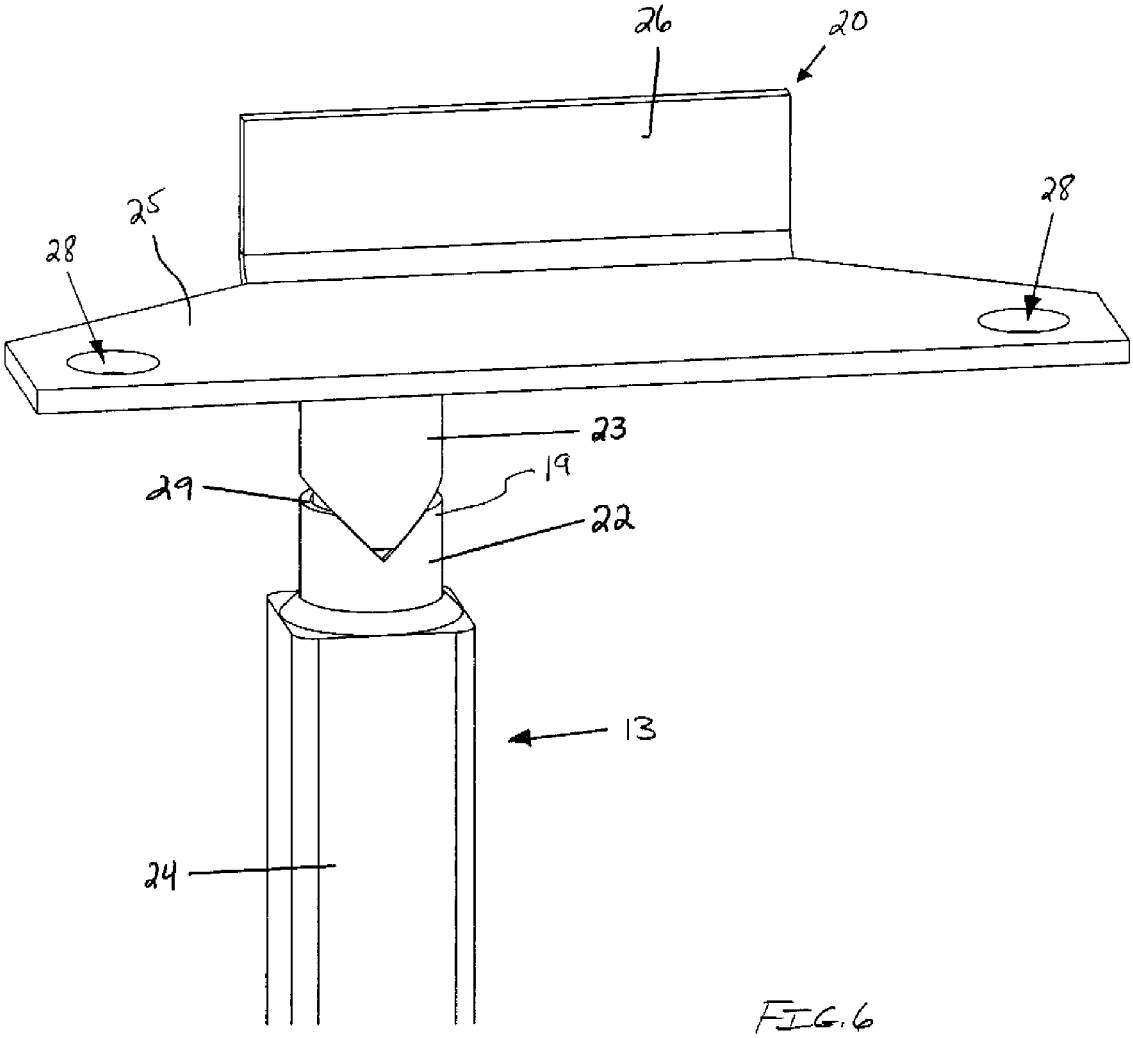
FIG. 6 is an enlarged fragmentary top perspective assembled view of the gravitating musical instrument support assembly in gravitated seated assembly with a fragmentary receiver construction according to the present invention.
Figure 7:
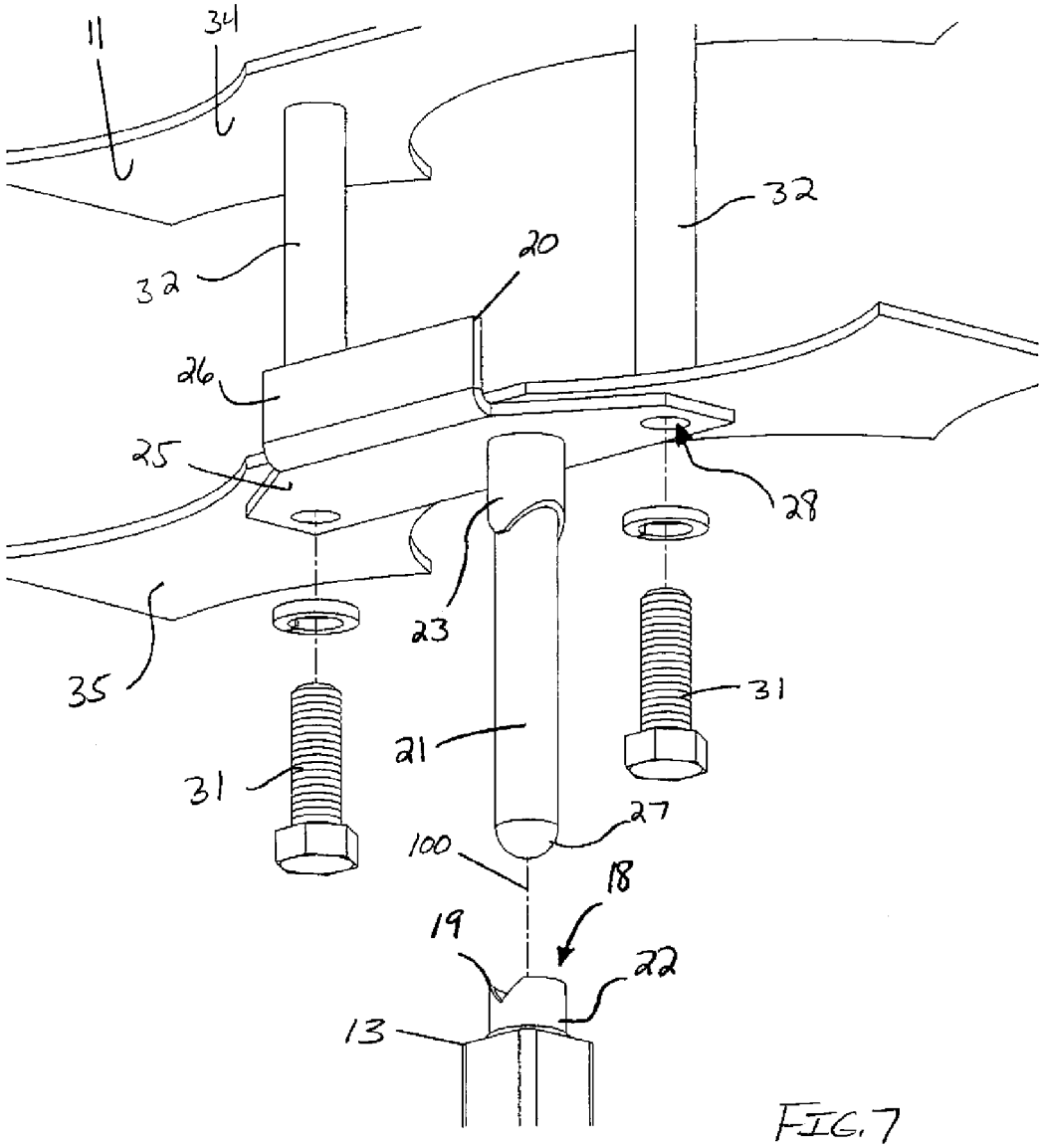
FIG. 7 is an enlarged fragmentary bottom perspective exploded view of the gravitating musical instrument support assembly juxtaposed in inferior adjacency to a fragmentary drum set support frame and in superior adjacency to a fragmentary receiver construction according to the present invention with certain fastening hardware for attaching the preferred gravitating instrument support assembly to the drum set support frame also shown in exploded relation.

Referring to FIGS. 5 and 6, it will be comparatively seen that the gravitating support assembly 20 is made cooperable with the receiver construction 13. The post 21 is preferably formed as a cylindrical rod with a hemispherical lower tip 27. The gravitating annular ring 23 is at the top end of the cylindrical rod or post 21 and is uniquely shaped to act as a gravitating element and orient the instrument in a preferred direction. The post 21 and gravitating annular ring 23 are secured to the mounting plate 25, which mounting plate 25 is preferably outfitted with mounting holes 28 and an optional flange as at 26.

Further referring to FIGS. 5 and 6, the receiver construction 13 is depicted as cooperable with the gravitating support assembly 20. At the top of the riser 24 is a sleeve 22, which is sized to mate with the post 21. At the top end of the sleeve 22 is the gravitating sleeve end 19, which end 19 is uniquely shaped to match or complement the gravitating annular ring 23. The riser 24, sleeve 22 and gravitating sleeve end 19 are permanently secured in order to function as a single monolithic unit. In the preferred embodiment the riser 24 has a square cross section to properly mate with the square cross section of the upright member 16. It will thus be seen that the sleeve riser 24 comprises a non-circular outer cross-section sized and shaped to mate with a non-circular inner cross-section of the upright member 16 of the stand assembly 10.

The fit between the circular vertical post 21 of the support assembly 20 and the cylindrical tubular sleeve 22 of the receiver construction 13 is of a close tolerance, such that the post 21 is free to rotate inside the sleeve 22 of the receiver construction 13. When the circular vertical post 21 of the support assembly 20 is placed into the cylindrical sleeve 22 of the receiver construction 13, it is free to rotate as at arrow 101 about a main vertical axis as at 100 with which the post axis 102 and sleeve axis 103 become coaxial when in assembled relation. Because the support assembly 20 is fastened to the drum set assembly 14 at or near the center-of-gravity of the drum set assembly 14, there is little or no torque on the vertical post 21, and thus this rotation has low resistance and it is easy for the performer to initiate the rotation 101 with a slight push.

The angular momentum of the rotating drum set assembly 14 operates such that the gravitating annular ring 23 periodically seats in the V-shaped slotted end 19 of the sleeve 21 at 0 rotational degrees as at 110, and 180 rotational degrees as at 112; and rides upon the upper surface 29 of the slotted end 19 at 90 and 270 rotational degrees during a 360 degree single rotation. In this regard, the reader will note that the gravitating annular ring 23 preferably comprises a flattened lower end 30 of the V-shape that complements the V-shaped slotted end 19. The flattened lower end 30 rides upon the smooth upper surface 29 of the slotted end 19 when passing the 90 degree point (as at 111) and 270 degree point (as at 113) during the 360 degree cycle.

The gravitating annular sleeve 22 and the gravitating annular ring 23 thus mate together. When the gravitating annular sleeves are in the preferred orientation at (i.e. at zero (0) rotational degrees as at 110) there will be no rotational force; gravity seats the annular ring 23 in the sleeve via the V-shaped slotted end 19 of the sleeve 22 and the V-shaped lower portion of the ring 23. When the gravitating annular sleeves are rotated out of their preferred orientation then there will be a rotational force or angular momentum on the drum set assembly 14. Friction at the interface of the sleeve 22 and ring 23 reduces the angular momentum and eventually the drum set assembly comes to rest in the preferred orientation (i.e. at zero (0) rotational degrees as at 110) for practice or performance.

The mounting plate 25 is preferably attached to the support frame 11 or 12 via certain fastening means, as may be exemplified by threaded fasteners as at 31. In this regard, it will be recalled that the mounting plate 25 preferably comprises mounting holes 28. The mounting holes 28 comprise an inner diameter sufficient to abut the cylindrical sleeve units or casings as at 32, which units casings 32 are connected to both the support frame(s) 11 or 12 and the drums 33 of the drum set assembly 14. According to state of the art drum construction, a threaded member 31 may be threadably received within a cylindrical sleeve unit or casing 32 so as to fasten the drum 33 to the support frame 11 or 12. The mounting plate 25 according to the present invention may be fastened to the support frame 11 or 12 via the threaded member(s) 31 and the units or casings 32.

While the foregoing specifications set forth much specificity, the same should not be construed as setting forth limits to the invention but rather as setting forth certain preferred embodiments and features. For example, as prefaced hereinabove, it is contemplated that the present invention essentially provides an instrument support assembly for use in combination with a stand assembly, which instrument support assembly essentially comprises a post portion having an axial post of cylindrical shape being mounted to an instrument; and a sleeve portion having an axial sleeve of cylindrical inside-cross-section sized to mate with the post. The post axis is referenced at 102 and the sleeve axis is referenced at 103.

The post portion (as at support assembly 20) comprises an integral gravitating annular ring as at 23, which annular ring 23 is formed at an upper portion of the post 21. The annular ring 23 comprises an angled lower edge as at 41 and a flat ring section as at 30 perpendicular to the sleeve axis 103 adjacent the angled lower edge 41. The sleeve portion (as at receiver construction 13) comprises an integral gravitating sleeve end as at 19, which sleeve end 19 is formed at a sleeve top of the sleeve 22. The sleeve end 19 comprises an angled upper edge as at 42 and a flat sleeve section as at 29 adjacent the angled upper edge 42.

Together, the angled upper edging 42 of the sleeve or receiver construction 13 is matable with the angled lower edging 41 of the annular ring 23 for causing the alignment of the instrument in a consistent orientation relative to the stand assembly 10. Notably, the annular ring comprises two opposed angled lower edges 41 in the shape of a V, and two flat ring sections as at 30 extend intermediate the opposed angled lower edges 41. Further, the sleeve end 19 comprises two opposed angled upper edges as at 42 and two opposed flat sleeve sections as at 29 intermediate the adjacent angled upper edges 42.

Figure 8:
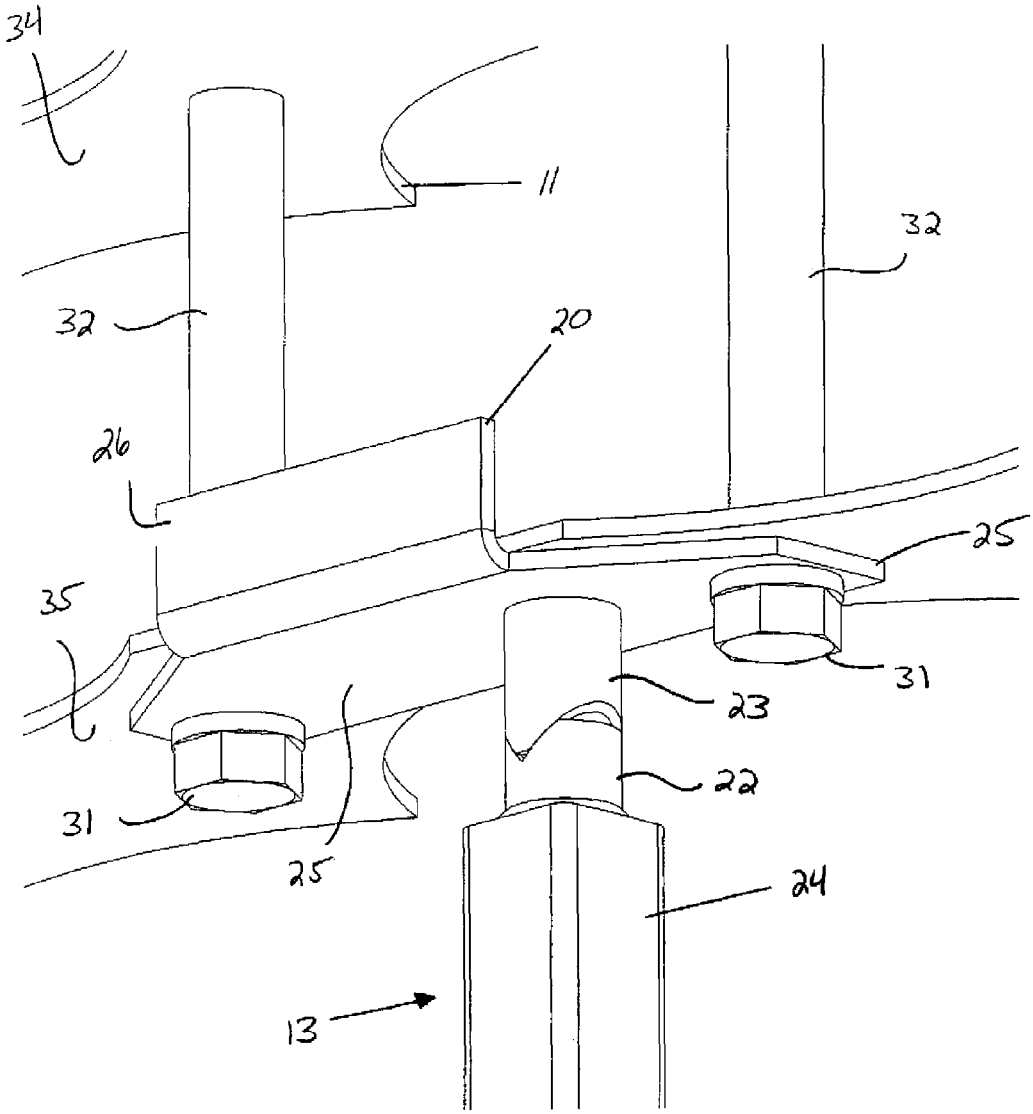
FIG. 8 is an enlarged fragmentary bottom perspective assembly view of the gravitating musical instrument support assembly fastened to the drum set support frame with certain fastening hardware and in gravitated seated assembly with a fragmentary receiver construction according to the present invention.

The angled lower edges, the flat ring sections, the angled upper edges, and the flat sleeve sections enable rotation of the post 21 about the post axis 102 relative to the sleeve portion or receiver construction 13 at a ring-to-sleeve interface, said interface being defined by opposed edging 41 and 42, and the flat sections 29 and 30. The annular ring 23 and the sleeve end 19 preferably comprise substantially uniform outer structural diameters as generally depicted in FIGS. 6 and 8, which outer structural diameters may well function to effectively camouflage the ring-to-sleeve interface from passersby.

Figure 9:
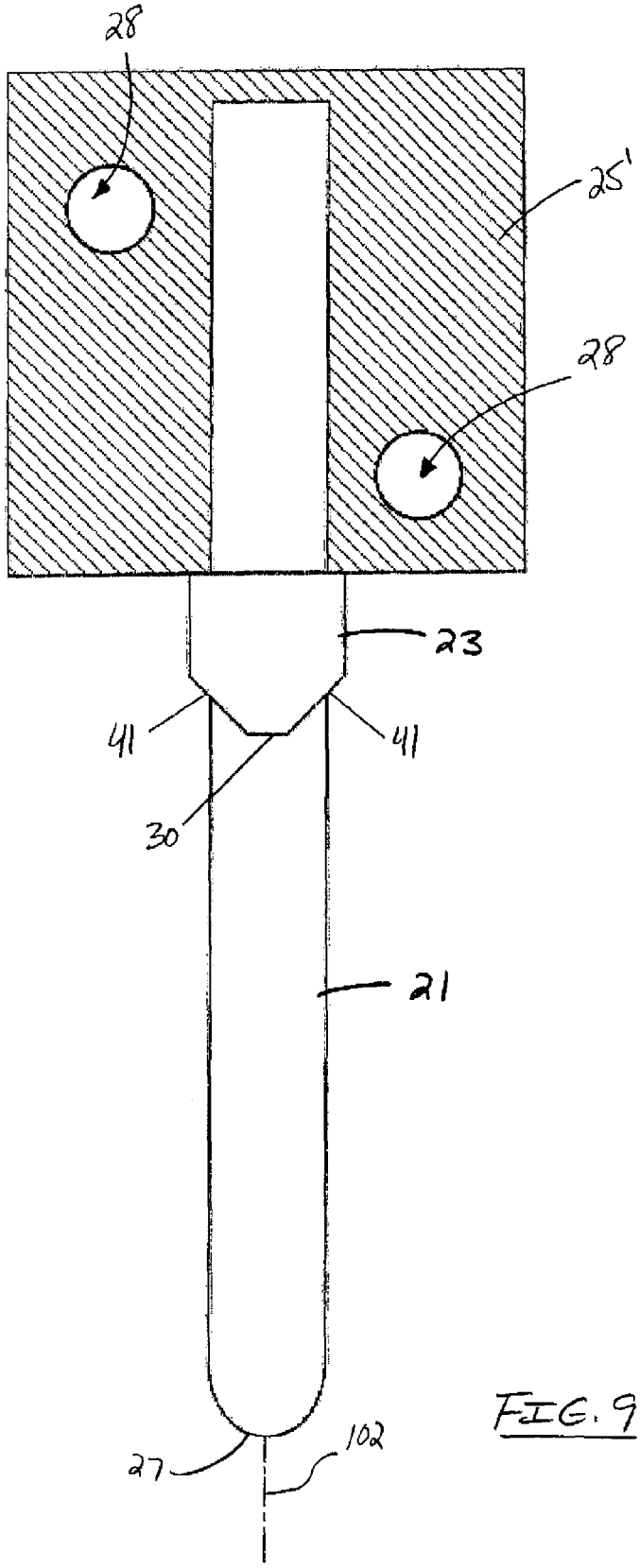
FIG. 9 is an alternative gravitating instrument support assembly according to the present invention.
Figure 11:
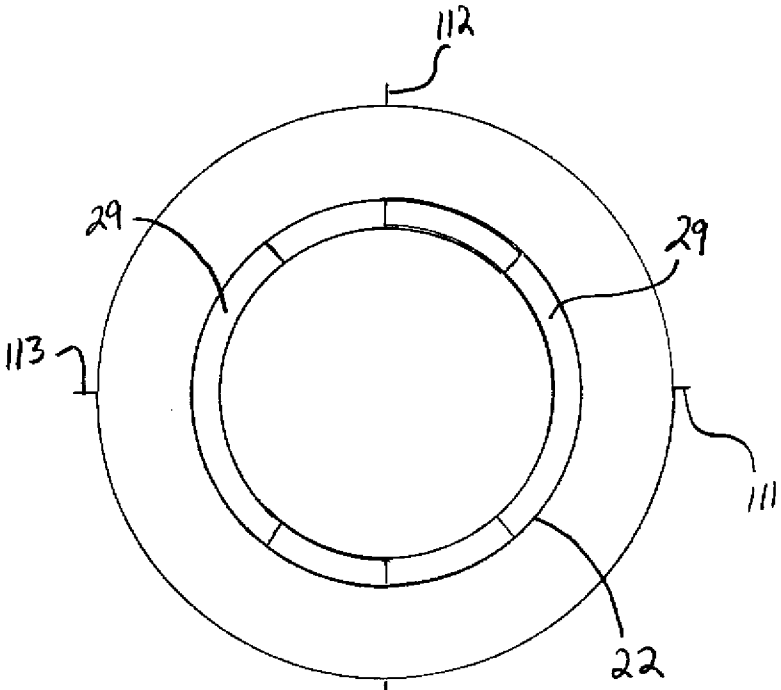
FIG. 11 is an enlarged top plan view of the structures otherwise shown in FIG. 10, the enlarged view being presented to show relative rotational degree points around the circumference of the structure.
Figure 10:
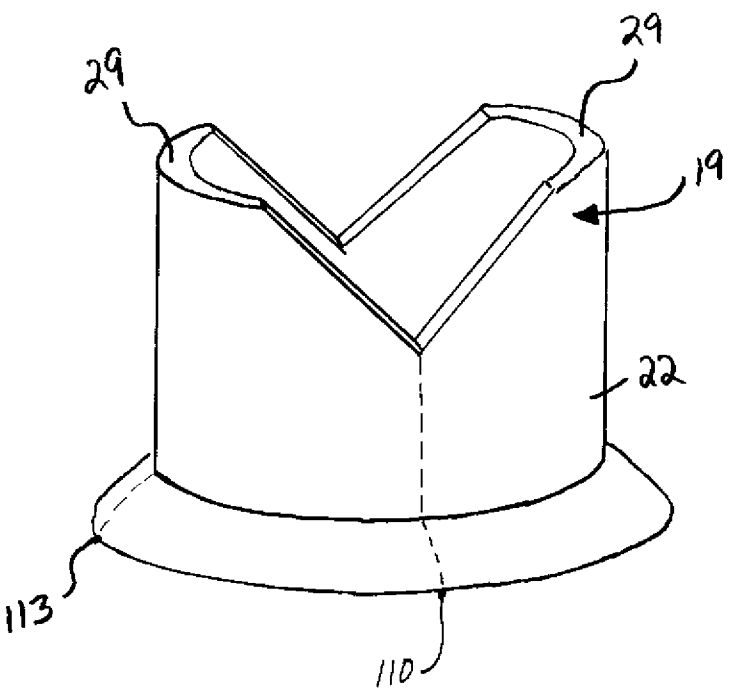
FIG. 10 is an enlarged fragmentary top perspective view of the sleeve of the receiver construction according to the present invention, the enlarged view being presented to show in greater detail the surfacing at the slotted upper sleeve end of the receiver construction.

The gravitation musical instrument support assembly according to the present invention further preferably comprises an integral mounting plate as preferably depicted and referenced at 25, and as alternatively depicted and referenced at 25' in FIG. 9. The mounting plate(s) 25/25' each preferably comprise mounting holes as at 28 sized to be cooperable with commercially available instruments and fasteners. From a comparative inspection of plate 25 versus plate 25', it will be seen that mounting plate may have a select planar orientation, as selected from the group consisting of a first orientation and a second orientation, the first orientation being orthogonal to the sleeve axis 103 or post axis 102, and the second orientation being parallel to the sleeve axis 103 or post axis 102.

Thus, specific embodiments and applications for a Gravitating Musical Instrument Support have been disclosed. It should be apparent, however, to those skilled in the art that many more modifications besides those described are possible without departing from the inventive concepts herein. The inventive subject matter, therefore, is not to be restricted except in the spirit of the appended claims.

I claim:

1. A combination percussion instrument support and stand assembly, the percussion instrument support and stand assembly comprising, in combination:

a stand assembly, the stand assembly having a vertically upright member;

a post, the post having a post axis and a cylindrical shape, the post being mounted to a percussion instrument;

a sleeve, the sleeve having a sleeve axis, a cylindrical inside-cross-section, the sleeve being matable with the upright member of the stand assembly in a vertical orientation, the cylindrical inside-cross-section being sized to mate with the post such that the post and sleeve axes are coaxial;

an integral gravitating annular ring, the annular ring being formed at an upper portion of the post, the annular ring having an angled lower edge and a flat ring section perpendicular to the post axis at the lower edge; and an integral gravitating sleeve end, the sleeve end being formed at the end of the sleeve, the sleeve end having an angled upper edge and flat sleeve section perpendicular to the sleeve axis, the angled upper edge of the sleeve being matable with the angled lower edge of the annular ring adjacent the upper portion of the post for causing the alignment of the percussion instrument in a consistent orientation relative to the stand assembly.

2. The combination of claim 1 comprising an integral mounting plate, the mounting plate comprising mounting holes, the mounting holes being sized to be cooperable with commercially available percussion instruments.

3. The combination of claim 2 comprising a strengthening flange, the strengthening flange cooperably associated with the mounting plate for increasing structural strength of the percussion instrument support assembly.

4. The combination of claim 1 wherein the angled lower edge, the flat ring section, the angled upper edge, and the flat sleeve section enable rotation of the post about the post axis relative to the sleeve.

5. The combination of claim 4 wherein the annular ring and the sleeve end comprise substantially uniform outer structural diameters, the substantially uniform outer structural diameters for camouflaging a ring-to-sleeve interface, the ring-to-sleeve interface being defined by opposed edging at the angled lower edge, the flat ring section, the angled upper edge, and the flat sleeve section.

6. The combination of claim 1 wherein the upright member comprises a non-circular upright cross-section and the sleeve comprises a non-circular outer cross-section, the non-circular outer cross-section being sized and shaped to mate with the non-circular upright cross-section.

7. A musical instrument support assembly for use in combination with a stand assembly, the musical instrument support assembly comprising:

a post, the post having a cylindrical shape and being mounted to a musical instrument;

a sleeve, the sleeve having a sleeve axis, a cylindrical inside-cross-section, and means for being supported in a vertical orientation by the stand assembly, the cylindrical inside-cross-section being sized to mate with the post;

an integral gravitating annular ring, the annular ring being formed at an upper portion of the post, the annular ring having an angled lower edge and a flat ring section perpendicular to the post axis adjacent the lower edge; and an integral gravitating sleeve end, the sleeve end being formed at a sleeve top of the sleeve, the sleeve end having an angled upper edge and a flat sleeve section perpendicular to the sleeve axis adjacent the angled upper edge, the angled upper edge of the sleeve being matable with the angled lower edge of the annular ring adjacent the upper portion of the post for causing the alignment of the musical instrument in a consistent orientation relative to the stand assembly.

8. The musical instrument support assembly of claim 1 comprising an integral mounting plate, the mounting plate comprising mounting holes, the mounting holes being sized to be cooperable with commercially available musical instruments.

9. The musical instrument support assembly of claim 8 comprising a strengthening flange, the strengthening flange cooperably associated with the mounting plate for increasing structural strength of the musical instrument support assembly.

10. The musical instrument support assembly of claim 7 wherein the angled lower edge, the flat ring section, the angled upper edge, and the flat sleeve section enable rotation of the post about the post axis relative to the sleeve.

11. The musical instrument support assembly of claim 7 wherein the annular ring and the sleeve end comprise substantially uniform outer structural diameters, the substantially uniform outer structural diameters for camouflaging a ring-to-sleeve interface, the ring-to-sleeve interface being defined by opposed edging at the angled lower edge, the flat ring section, the angled upper edge, and the flat sleeve section.

12. The musical instrument support assembly of claim 7 wherein the sleeve comprises a non-circular outer cross-section, the non-circular outer cross-section being sized and shaped to mate with a non-circular upright inner cross-section of the stand assembly.

13. An instrument support assembly for use in combination with a stand assembly, the instrument support assembly comprising:

a post with a post axis and of a cylindrical shape being mounted to an instrument;

a sleeve of cylindrical inside-cross-section sized to mate with the post, the sleeve having a sleeve axis;

an integral gravitating annular ring, the annular ring being formed at an upper portion of the post, the annular ring comprising an angled lower edge and a flat ring section perpendicular to the sleeve axis adjacent the angled lower edge;

an integral gravitating sleeve end, the sleeve end being formed at the top of the sleeve, the sleeve end comprising an angled upper edge and a flat sleeve section adjacent the angled upper edge, the angled upper edge of the sleeve being matable with the angled lower edge of the annular ring for causing the alignment of the instrument in a consistent orientation relative to the stand assembly.

14. The instrument support assembly of claim 13 wherein the annular ring comprises two angled lower edges and two flat ring sections intermediate the angled lower edges; and the sleeve end comprises two angled upper edges and two flat sleeve sections intermediate the adjacent the angled upper edges, the angled upper edges of the sleeve being matable with the angled lower edges of the annular ring for causing the alignment of the instrument in a consistent orientation relative to the stand assembly.

15. The instrument support assembly of claim 13 comprising an integral mounting plate, the mounting plate comprising mounting holes, the mounting holes being sized to be cooperable with commercially available instruments.

16. The instrument support assembly of claim 15 wherein the mounting plate has a select planar orientation, the select planar orientation being selected from the group consisting of a first orientation and a second orientation, the first orientation being orthogonal to the sleeve axis, the second orientation being parallel to the sleeve axis.

17. The instrument support assembly of claim 15 comprising a strengthening flange, the strengthening flange cooperably associated with the mounting plate for increasing structural strength of the instrument support assembly.

18. The instrument support assembly of claim 13 wherein the angled lower edges, the flat ring sections, the angled upper edges, and the flat sleeve sections enable rotation of the post about the post axis relative to the sleeve.

19. The instrument support assembly of claim 13 wherein the annular ring and the sleeve end comprise substantially uniform outer structural diameters, the substantially uniform outer structural diameters for camouflaging a ring-to-sleeve interface, the ring-to-sleeve interface being defined by opposed edging at the angled lower edges, the flat ring sections, the angled upper edges, and the flat sleeve sections.

20. The instrument support assembly of claim 13 wherein the sleeve comprises a non-circular outer cross-section, the non-circular outer cross-section being sized and shaped to mate with a non-circular upright inner cross-section of the stand assembly.

* * * * *